US006302967B1

(12) United States Patent
Rohrbacher et al.

(10) Patent No.: US 6,302,967 B1
(45) Date of Patent: Oct. 16, 2001

(54) MOBILE CYCLONIC POWER WASH SYSTEM WITH WATER RECLAMATION AND ROTARY UNION

(75) Inventors: Richard David Rohrbacher; Judith Mae Jacobson, both of Phoenix, AZ (US)

(73) Assignee: Cyclone Surface Cleaning, Inc., Tempe, AZ (US)

( * ) Notice: Subject to any disclaimer, the term of this patent is extended or adjusted under 35 U.S.C. 154(b) by 0 days.

(21) Appl. No.: 09/663,243

(22) Filed: Sep. 15, 2000

(Under 37 CFR 1.47)

Related U.S. Application Data

(63) Continuation of application No. 08/615,797, filed on Mar. 14, 1996, now abandoned, which is a continuation of application No. 08/343,193, filed on Nov. 22, 1994, now abandoned, which is a division of application No. 08/118,139, filed on Sep. 8, 1993, now Pat. No. 5,500,976.

(51) Int. Cl.[7] ..... B08B 3/02

(52) U.S. Cl. ..... 134/10; 134/6; 134/21; 134/34; 134/37; 134/40; 134/109; 15/320; 15/321; 15/353

(58) Field of Search ..... 134/6, 10, 21, 134/34, 37, 40, 109; 15/320, 321, 353

(56) References Cited

U.S. PATENT DOCUMENTS

| | | | | |
|---|---|---|---|---|
| 4,107,816 | * | 8/1978 | Matthews | 15/320 |
| 4,191,589 | * | 3/1980 | Halls et al. | 134/21 |
| 4,194,263 | * | 3/1980 | Herpers et al. | 15/353 |
| 4,391,450 | * | 7/1983 | Beck | 277/1 |
| 5,134,748 | * | 8/1992 | Lynn | 15/321 |
| 5,174,614 | * | 12/1992 | Kaleniecki | 285/279 |
| 5,203,575 | * | 4/1993 | Azibert et al. | 277/59 |
| 5,224,236 | * | 7/1993 | Sallquist | 15/321 |
| 5,253,809 | * | 10/1993 | Poppitz et al. | 239/257 |
| 5,265,805 | * | 11/1993 | Artenian | 239/135 |
| 5,331,713 | * | 7/1994 | Tipton | 15/321 |
| 5,469,597 | * | 11/1995 | Page | 15/321 |
| 5,500,976 | * | 3/1996 | Rohrbacher | 15/353 |
| 5,501,396 | * | 3/1996 | Rohrbacher et al. | 239/7 |
| 5,601,659 | * | 2/1997 | Rohrbacher et al. | 134/10 |
| 5,704,989 | * | 1/1998 | Page | 134/10 |
| 5,718,015 | * | 2/1998 | Rohrbacher et al. | 15/321 |

OTHER PUBLICATIONS

Cyclone Newsletter, vol. 4, pp. 1–2, Oct. 2000.*

* cited by examiner

*Primary Examiner*—Sharidan Carrillo
(74) *Attorney, Agent, or Firm*—Brinks Hofer Gilson & Lione

(57) ABSTRACT

A cyclonic power wash system uses high pressure, high temperature water for selectively cleaning large, flat, concrete or asphalt surfaces. The sprayed water is reclaimed by vacuuming it through holes in the bottom of a reclamation ring attached to the underside of the mobile cyclone sprayer, filtering the vacuumed water and returning it to a storage tank for re-use by the system. The filtration tank initially filters out large matter in an inlet trough and smaller matter in a plurality of cascading chambers. A rotary union in the sprayer prevents the water, passing from the inlet of the rotary union to the discharge thereof, from leaking through or around a seal formed by pressing together a pair of hard, durable sealing surfaces, for example, silicon carbide, one of which is non-rotatably slidingly received in an upper recess of the union's fixed housing and the other, affixed to a spindle rotatably received and retained in a lower recess of the housing. The sliding fit interface of the non-rotatable seal face in the upper recessed housing is sealed by an o-ring supported at its inner bore by extended portions adjacent the central bores of the members between which it is sandwiched. Upward and rotational forces are applied to the spindle in reaction to the water exiting from nozzles affixed to a spray bar attached to the spindle.

7 Claims, 4 Drawing Sheets

ROTATED 180°

MOBILE CYCLONIC POWER WASH SYSTEM WITH WATER RECLAMATION AND ROTARY UNION

This application is a continuation of application number 08/615,797, filed Mar. 14, 1996, now abandoned, which is a continuation of application Ser. No. 08/343,193 filed Nov. 22, 1994, now abandoned. which is a divisional application of Ser. No. 08/118,139 filed Sep. 8, 1993, now U.S. Pat. No. 5,500,976.

BACKGROUND OF THE INVENTION

1. Fields of the Invention

The present invention relates generally to a mobile cyclonic power wash system that uses sprayed water for cleaning flat surfaces such as concrete, asphalt, and other various hard surfaces, and more particularly, to a power wash system having a system which reclaims and filters the sprayed water and recycles the filtered water to the system for further use in cleaning. The present invention also relates to a mobile cyclone sprayer that has an improved rotary union, which passes high pressure, high temperature water to a spray bar which rotates at high speeds, and more particularly, to an improved leakproof rotary union seal formed between a non-rotatable silicon carbide seal surface and a rotatable silicon carbide seal surface which prevents the water from leaking through or around the seal. The power wash system with these new and improved features provides more effective and convenient cleaning of flat surfaces.

2. Discussion of Background and Prior Art

Apparatus and methods for selectively cleaning flat surfaces using a mobile cyclonic power wash system have been well known in the art. The mobile cyclonic power wash system generally sprays water at high rotating speeds to clean the surfaces. A typical mobile cyclonic power wash system includes a water storage means for holding the water to be used for cleaning, a water pumping system used for pumping and pressurizing the water from the storage means, and a water cyclone sprayer for spraying the water onto the surfaces. This power wash system can further include a water heating system for heating the water so that high temperature as well as high pressure water is provided for cleaning surfaces.

Halls et al. U.S. Pat. No. 4,191,589 ("Halls") and Sundheim U.S. Pat. No. 4,191,590 ("Sundheim") each disclosed a power wash system that uses a vacuum system, and these systems were designed to be used for cleaning carpets and hard surfaces such as streets and floors. Goerss U.S. Pat. No. 4,337,784 ("Goerss") disclosed a high pressure water system that is designed to be used for cleaning floor surfaces and floor gratings.

One of the problems with the prior art power wash systems is that none of them provided any means for recovering, filtering, and recycling the water sprayed by the power wash system. The prior art systems were not designed to be independent, self-contained systems in which the water is continuously reclaimed, filtered, and recycled for further use by the power wash system. Therefore, the operation of the prior art systems is limited by the amount of water that can be stored or transported by the system (i.e. by the capacity of the water storage means), and the operator of the system was inconvenienced in having to replenish additional water from an outside source when the stored water was depleted. In effect, these prior art systems required the use of large amounts of water, and these systems wasted the stored water since they did not have the capability of reclaiming and re-using it. Moreover, environmental objections are increasingly being raised to harmful wastes being dumped into local drainage systems. Thus, there is a need to reclaim the sprayed water used in outdoor cleaning systems.

Rotary unions used in water cyclone sprayers of mobile cyclonic power wash systems have been well known in the art.

As shown in FIG. 6, one typical prior art rotary union 200 comprised simply a circular housing 210 and a hollow rotary spindle 220. The spindle 220 has a flat radial seal ring flange 240 to support it in the housing 210. A spray bar 54 is attached to the bottom of spindle 220. A packing gland 250 is placed on the inlet side of flange 240, and a packing unit and nut 260 is placed on the outlet side of flange 240. Packing unit 260 is screwed to the housing 210 by screw threads in order to support the flange 240 and to seal the bottom end of the rotary union 200. As the glands 250 wore out, the nut on the packing unit 260 had to be continuously tightened to prevent leaking in the rotary union 200. Under high pressure and high temperature, the glands wore out rapidly.

The use of o-rings or similar sealing means to seal a rotating shaft are well known in the prior art. However, due to the high pressure and high temperature and high rpm environment in a cyclone power wash sprayer of the present invention, the prior art o-rings themselves cannot function as the primary sealing means between the stationary and rotating members of the sprayer. Moreover, when positioned directly in the high pressure, high temperature water flow path as a bypass seal, the prior art fails to disclose the additional means required to prevent the o-ring itself from being carried away with the water flowing past it.

Beck U.S. Pat. No. 4,391,450 disclosed a shaft seal that uses two seal surfaces, one rotatable and the other stationary to provide the seal for the rotary union. The problem with this system is that it uses a hard material, such as silicon carbide, for the rotating seal surface, while using a softer material, such as boron nitride, for the stationary seal surface. Thus, the softer seal surface rapidly wears out against the harder seal surface. Therefore, a more effective means for sealing the rotary union is desired to overcome these problems.

High water pressure and high speed rotation of the spray bar is required in mobile power washers in order to remove ground in dirt, grease, oil, grime, and the like from the surfaces. The main purpose of the rotary union in such devices is to act as a coupling for passing the high temperature, high pressure water to the high speed rotating spray bar without leaking through or around the rotary union. The problem with the prior art rotary unions described above is that the parts of the rotary union wore out very fast because the device was operated under high pressure, high temperature and at high rpm. The rapid wearing out of these parts caused the seal of the rotary union to leak with the result that the water cyclone sprayer could not function properly or effectively.

In overcoming the problems and limitations of the prior art, it is an object of the present invention to clean flat surfaces using a mobile cyclonic power wash system with a water reclamation and filter recycling system, which reclaims and filters the water sprayed by the power wash system and has the capacity to return up to 100% of the water used by the power wash system as filtered water to be further used for cleaning by the power wash system.

It is a further object of the present invention to clean flat surfaces using a mobile cyclonic power wash system with an improved rotary union seal formed between a non-rotatable sealing surface engaging a high speed rotatable sealing surface with the high pressure, high temperature water flowing through a central bore through the union.

It is another object of the present invention to clean flat surfaces using a mobile cyclonic power wash system with an improved rotary union having an o-ring preventing bypass of the high pressure, high temperature water around the high speed rotary union.

SUMMARY OF THE INVENTION

Set forth below is a brief summary of the invention in order to solve the foregoing problems and achieve the foregoing and other objects, benefits, and advantages in accordance with the purposes of the present invention as embodied and broadly described herein.

One aspect of the invention is in a cyclonic power wash system which uses high pressure water for selectively cleaning flat surfaces. The system includes a water storage means for holding water to be used for cleaning, a water pumping system for pumping and pressurizing the water from the storage means and a water cyclone sprayer for spraying the water onto the surfaces. The improvement in the system includes a water reclamation and filter recycling system for reclaiming and filtering water that is sprayed by the system and recycling the filtered water into the storage means so that it can be further used for cleaning by the system. The system also preferably includes a water heater for heating the water.

A further feature of this aspect of the invention is a hollow reclamation ring attached to the bottom of the cyclone sprayer having a plurality of holes on the bottom side of the ring through which the sprayed water is reclaimed, a water filtration tank coupled to the reclamation ring, a vacuum source coupled to the filtration tank providing a low pressure at the reclamation ring for vacuuming the sprayed water and transporting it to the filtration tank, and means to transport the filtered water back to the storage means for re-use.

A still further feature of this aspect of the invention is the construction of the filtration tank which includes an inlet at the top, a removable slanting trough below the inlet with a screened outlet at the bottom of the trough for filtering large matter from the water, a plurality of cascading chambers for allowing the water to successively fill a chamber and flow over into an adjacent chamber leaving behind smaller matter still present in the water continuously passing cleaner water to the next chamber, and a plurality of baffles for preventing matter and water from being directly vacuumed into the inlet of the vacuum pump system.

A still further feature of this aspect of the invention is a mobile platform on which the system components are mounted for transport to a job site.

A further aspect of the invention is in the water cyclone sprayer of the power wash system, which sprays high pressure, high temperature water at a high rotating speed. The improvement in this sprayer is in the rotary union seal, which is formed between two silicon carbide surfaces, one stationary and the other rotatable at high rpm with the water passing through a central bore through the sealing members which prevents leakage through the rotary union seal, and an o-ring which prevents leakage around the rotary union seal.

A further feature of this aspect of the invention is the method of effecting the seals in the rotary union which includes non-rotatably, slidingly mounting within the central bore of the housing a cylindrical support member which has affixed to one end thereof a first silicon carbide seal face. The support member has a central bore therethrough and the sliding mounting forms an interface between the central bore of the housing and the outer surface of the cylindrical support member. The method further includes slidingly sealing the interface by sandwiching an o-ring between the other end of the cylindrical support member and a downwardly biased washer with the o-ring slidingly engaging the housing central bore, retainingly, rotatably supporting within another central bore of the housing a spindle having a second silicon carbide seal face affixed to that end of the spindle adjacent the cylindrical support member and having a central bore therethrough to its discharge end; thereby, forming a rotary union by sealingly engaging the first and second silicon seal faces. In this method fluid, i.e. water, entering the inlet end of the housing passes through the central bores of the members, o-ring, spindle and rotary union and out the discharge end of the spindle without leaking around or through the seal at the rotary union.

A further feature of this aspect of the invention includes supporting the inner bore of the o-ring by a downwardly axially extended inner bore portion of the biased washer and an upwardly axially extended inner bore portion of the other end of the cylindrical support member. This construction prevents the o-ring from being blown into the central bore of the cylindrical support member by the high pressure water present at the interface.

A still further feature of this aspect of the invention includes applying an upward force to the spindle to further sealingly engage the seal faces in reaction to the downward force of the fluid exiting from the nozzles affixed to the hollow spray bar, and applying a horizontal rotational force to rotate the spindle and spray bar at high rpm in reaction to the horizontal force of the water peripherally exiting from the nozzles affixed to each extremity of the spray bar.

DETAILED DESCRIPTION OF THE PRESENTLY PREFERRED EMBODIMENTS

Figure 1:
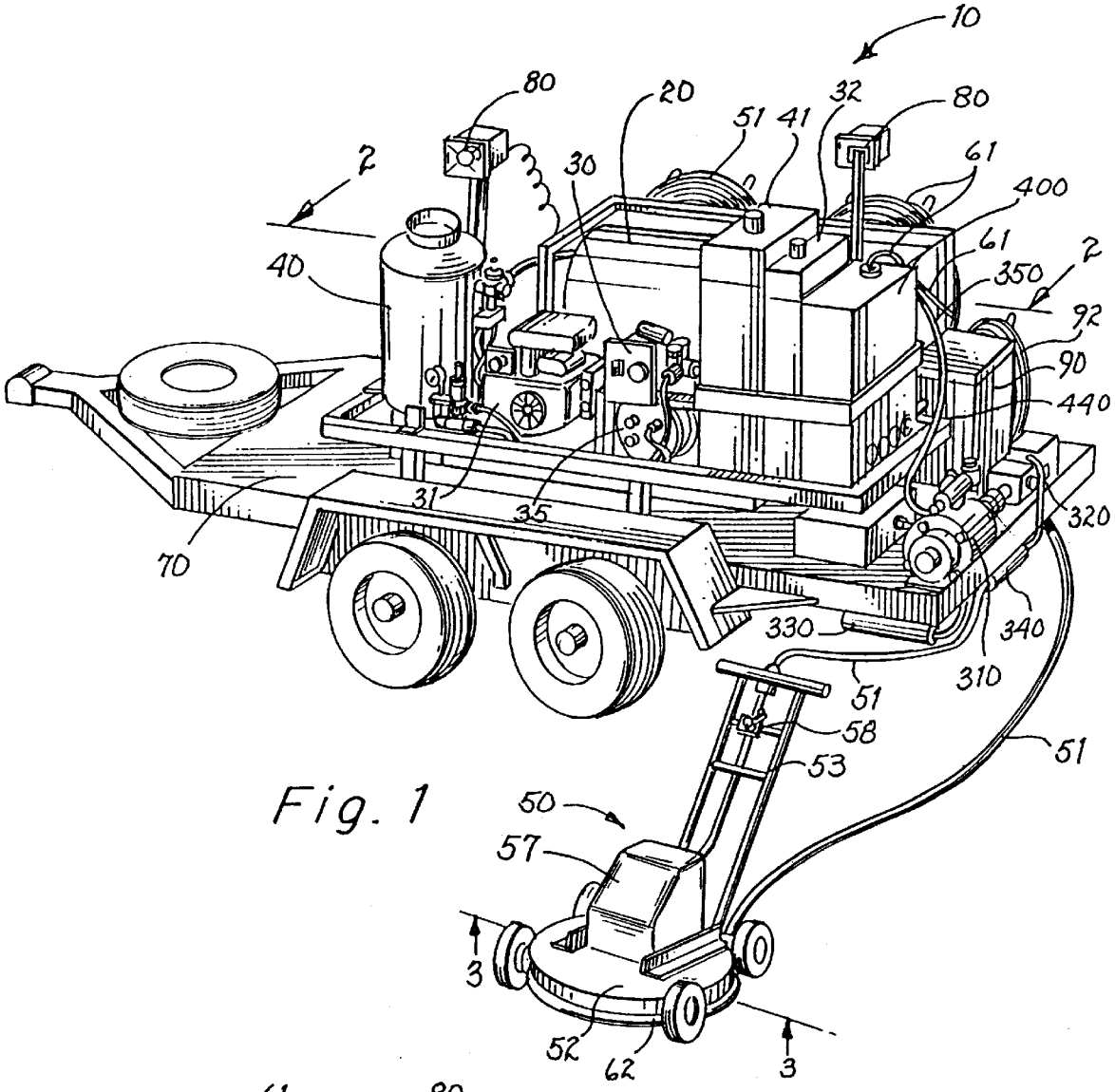
FIG. 1 is a front perspective view of a mobile cyclonic power wash system having a water reclamation and filter recycling system and an improved rotary union of the present invention.
Figure 2:
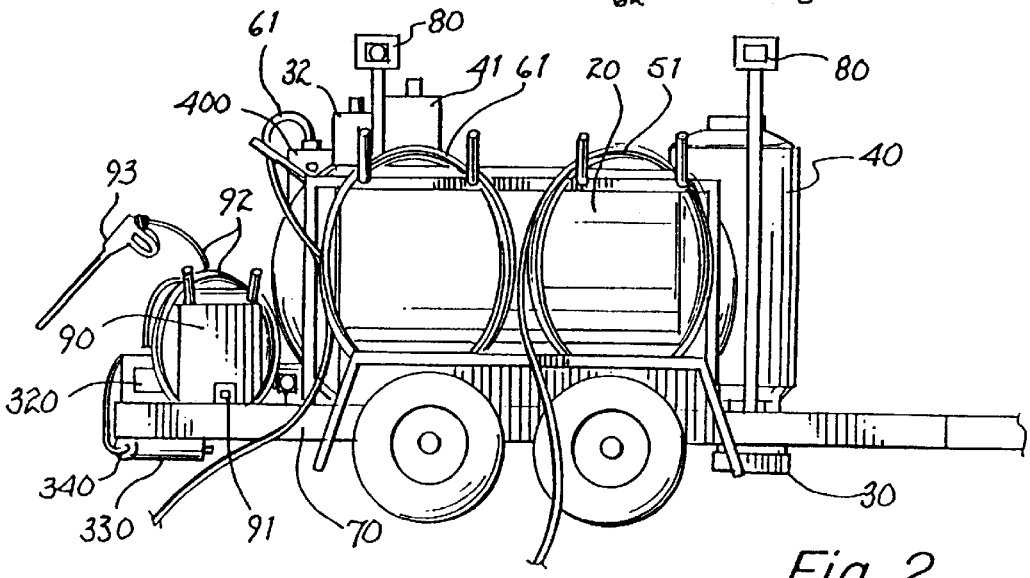
FIG. 2 is a rear elevation view of a mobile cyclonic power wash system having a water reclamation and filter recycling system and an improved rotary union taken along the line 2—2 of FIG. 1.
Figure 7:
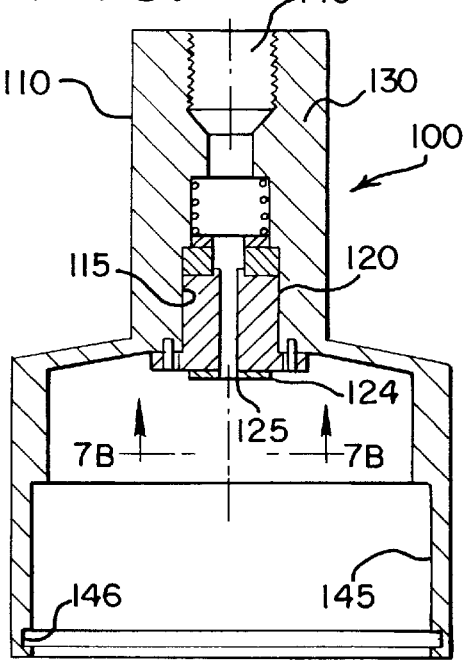
FIG. 7 is a sectional elevation view of a first subassembly of components for the proved rotary union of the present invention.
Figure 7A:
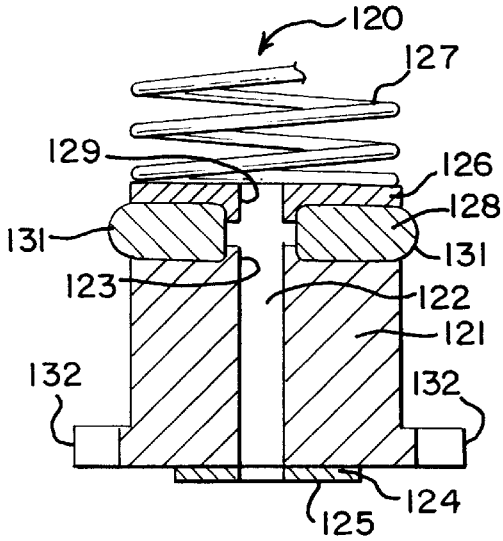
FIG. 7A is an enlarged elevation view in partial section of the first floating silicon carbide seal member that is a part of the improved rotary union shown in FIG. 7.
Figure 8:
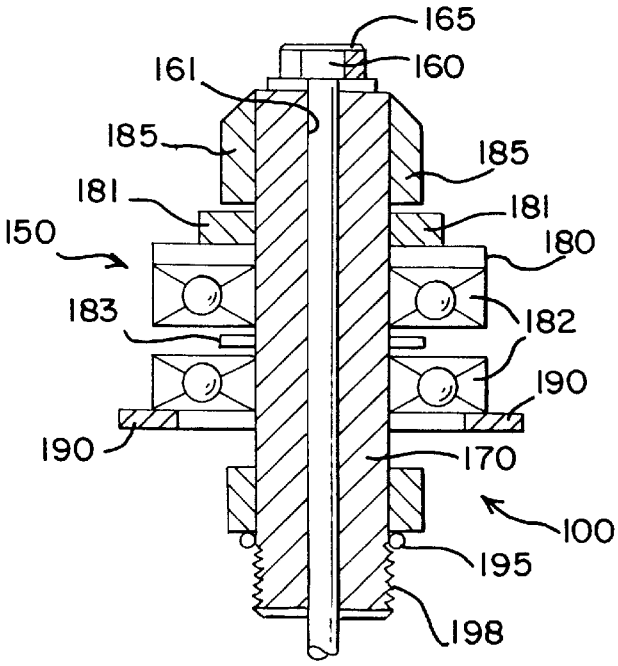
FIG. 8 is a sectional elevation view of the second subassembly of components for the improved rotary union.

FIGS. 1 and 2 respectively show front and rear views of a mobile cyclonic power wash system 10 which includes the novel water reclamation and filter recycling system 60 (shown generally in FIG. 3 but also including elements shown in FIGS. 3A, 4 and 5) for reclaiming and filtering water that is sprayed by the system and recycling the filtered water into a storage means 20 so that the water is re-used for cleaning. FIGS. 7, 7A and 8 respectively show elevation views of a first subassembly of components 110 and second subassembly of components 150 for an improved rotary union 100 (shown generally in FIGS. 7 and 8) used in the cyclonic power sprayer 50 in the power wash system 10. These features of the power wash system 10 are now described in more detail.

The Power Wash System

As seen in FIGS. 1 and 2, the mobile cyclonic power wash system 10 includes a water storage means 20 for holding the water to be used for cleaning by the system 10, a water pumping system 30 for pumping and pressurizing the water from the storage means 20, a water cyclone sprayer 50 for spraying the water to the surfaces to be cleaned, and a mobile platform 70 on which various system 10 components are mounted so that the power wash system 10 is transportable from job site to job site. A water heater 40 may also be included as part of the power wash system 10 for heating the water.

As a further option, the power wash system 10 can include a chemical treatment system 90. The treatment system 90 would be used prior to operating the power wash system 10 to apply chemicals to the surfaces to be cleaned in order to loosen hard to remove dirt, grease, oil, grime, and the like from these surfaces. The treatment system 90 comprises an independently power operated pump 91 which pumps the chemicals through a hose 92 and to a spray gun 93. The chemicals are then sprayed to the surfaces through spray gun 93.

The power wash system 10 operates by having the water in the storage means 20 pumped through a conduit 201 and pressurized by the pumping system 30. The pumping system 30 is typically a water pump that is driven by a gas-powered engine 31 which also powers a generator 35. The water may then be either pumped to a water heater 40 so that the water may be heated or directly pumped through a conduit 301 to a water cyclone sprayer 50 if no heat is desired. If the water is directed to a water heater 40, then the heater 40, which is powered by the generator 35, burns diesel fuel stored in fuel tank 41 to heat the water to an operating temperature of 250° F. A thermostatic electrical switch (not shown) turns the oil burner on when the water temperature falls to 230° F. and "off" when the water temperature rises to 255° F.

Figure 3:
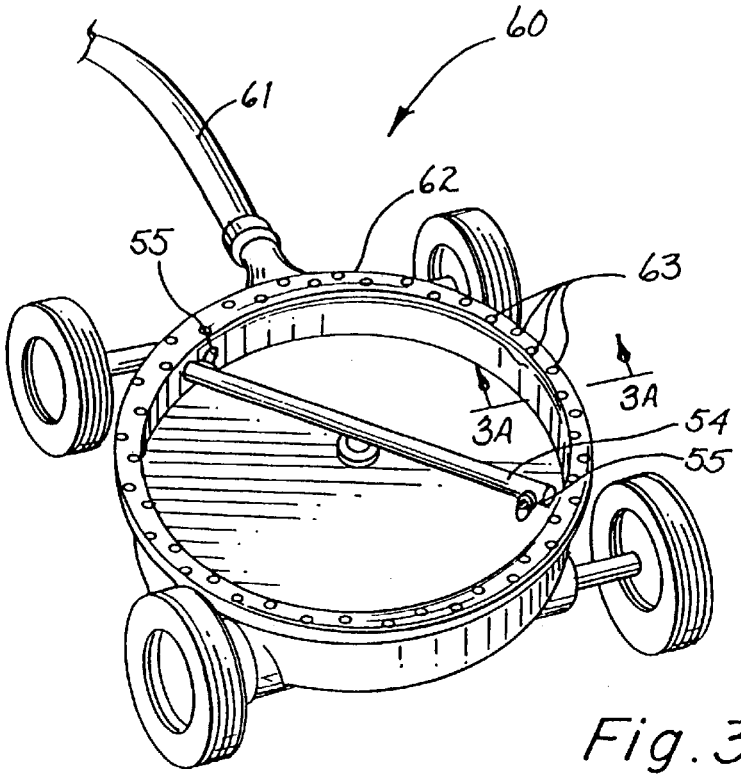
FIG. 3 is a bottom perspective view of a water cyclone sprayer of the present invention with a water reclamation ring attached.
Figure 6:
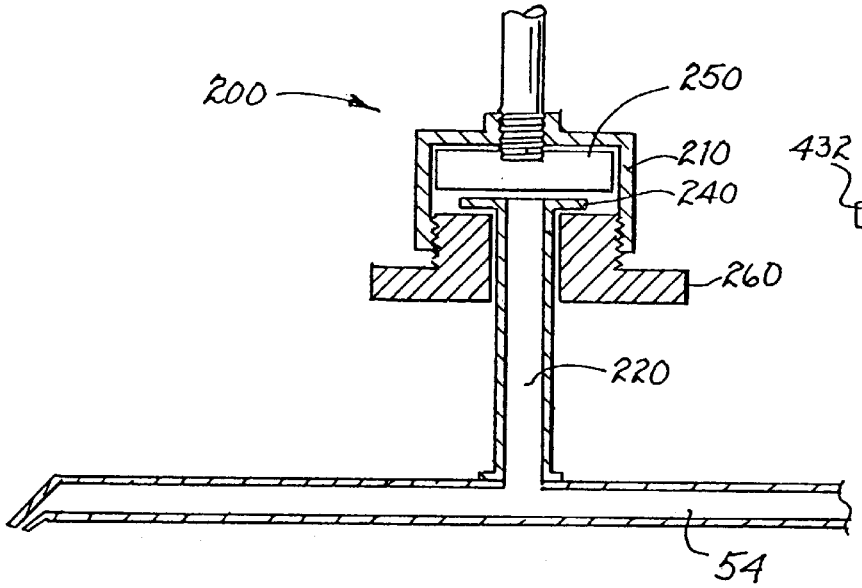
Fig.6 PRIOR ART
FIG. 6 is a sectional elevation view of a prior art rotary union comprising packing glands and packing units for the seal of a rotary union.

The water is then directed through a water transporting hose 51 and lever type on/off valve 58 to a water cyclone sprayer so. The water under high pressure and/or high temperature is sprayed through the sprayer 50 onto the surfaces to be cleaned. As shown in FIG. 1, the sprayer 50 comprises a mobile base 52 and a handle 53 mounted to base 52 so that the operator can move the sprayer 50 over various surfaces. FIG. 3 shows that the sprayer 50 (turned upside down in FIG. 3) has a spray bar 54 mounted underneath the sprayer 50 within the base 52. The spray bar 54 has nozzles 55 at its ends at a downward vertical angle of 6°–20° relative to the horizontal through which the water is downwardly sprayed onto the surfaces to be cleaned. A rotary union, such as the rotary union 200 shown in FIG. 6 or the rotary union 100 shown in FIGS. 7, 7A and 8 is mounted atop the center portion of base 52 underneath cover 57, and the spray bar 54 is attached to the spindle of the rotary union (i.e. spindle of rotary union 100 or 200). The horizontal reaction forces to high pressure and/or high temperature water passing through the rotary union and exiting through jets 55 causes the spray bar 54 to rotate at a very high speed, and the water is, in effect, sprayed at a downward angle onto the surfaces through nozzles 55 rotating at a high speed. This power wash system 10 is able to clean dirt, grease, oil, grime, and the like from flat surfaces such as asphalt lots and concrete floors. The power wash system 10 can also be adapted to be used at night by having lights 80, powered by generator 35, mounted to the mobile platform 70.

The Water Reclamation and Filter Recycling System

The improvement that has been made to this power wash system 10 is that a water reclamation and filter recycling system 60 has been included as part of the system 10 to reclaim and filter the water sprayed by the power wash system 10 and to further return the filtered water back to storage means 20 for further use in cleaning by power wash system 10. The reclamation and recycling system 60 comprises a detachable water reclamation ring 62 as shown in FIG. 3, a vacuum source 300 as shown in FIG. 4, and a filtration tank 400 as shown in FIG. 5.

Figure 3A:
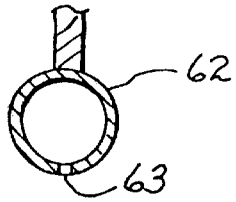
FIG. 3A is a cross-sectional view of the water reclamation ring taken along the line 3A—3A of FIG. 3.

As shown in FIG. 3, the ring 62 is mounted to the bottom side perimeter of the base 52 of sprayer 50 encircling spray bar 54. After the sprayer 50 sprays the water onto the surfaces, the water can then be reclaimed from the surfaces through this ring 62. As shown in FIGS. 3 and 3A, the ring 62 is hollow and contains a plurality of holes 63, which are on the bottom side of the ring 62 and these holes 63 face the surfaces to be cleaned. A transporting hose 61 is attached to an end of ring 62 so that the water can be transported to a filtration tank 400.

Figure 4:
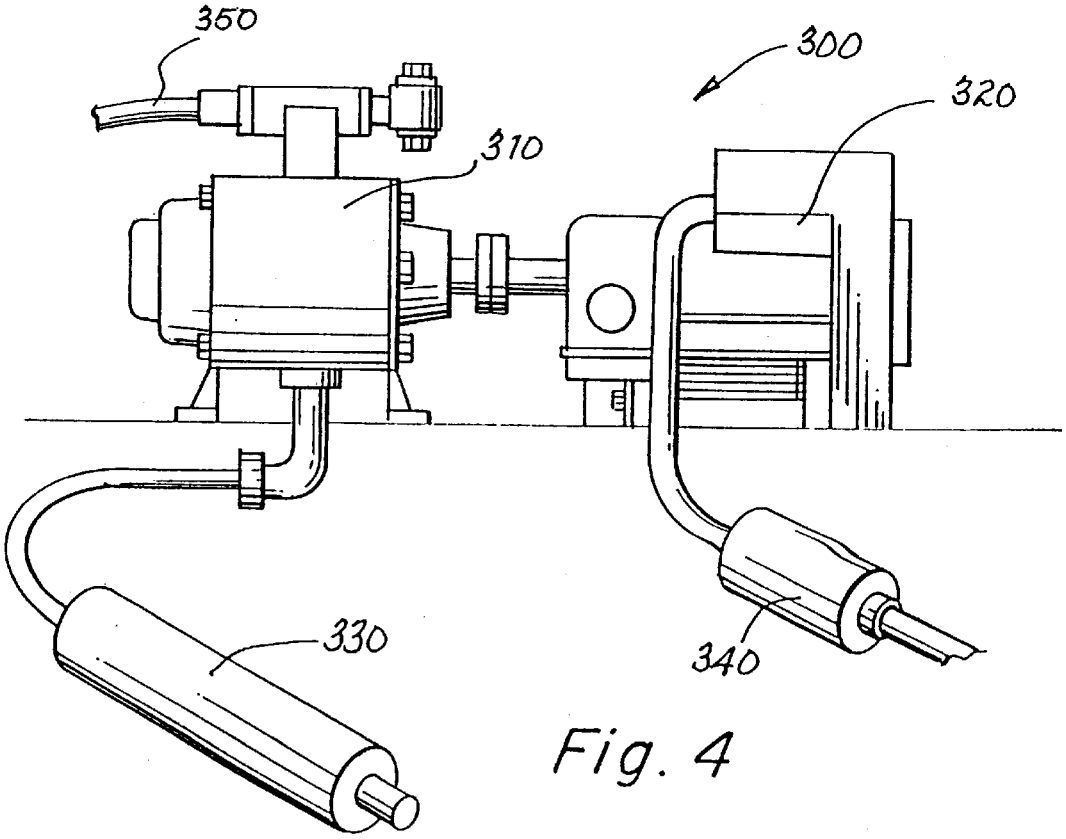
FIG. 4 is a front elevation view of the vacuum source for the water reclamation and filter recycling system of the present invention.
Figure 5:
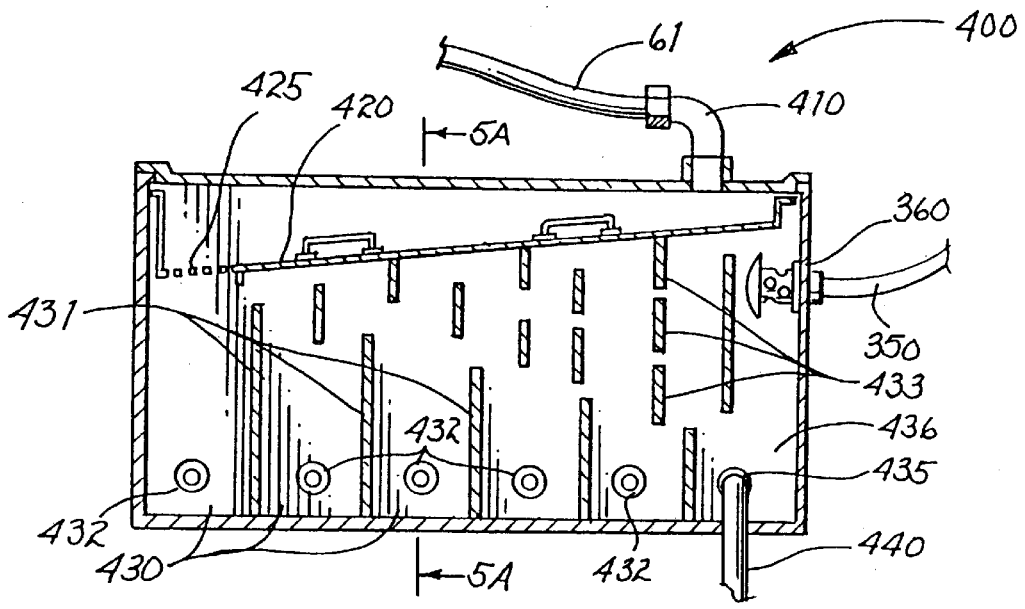
FIG. 5 is a front sectional elevation view of the water filtration tank for the water reclamation and filter recycling system of the present invention.

The water (along with stones, debris and other matter small enough to fit through holes 63) is vacuumed or sucked through the holes 63 and through the hose 61 to a filtration tank 400 by the use of vacuum source 300 in FIG. 4. Vacuum source 300 comprises a vacuum pump 310 and a gas driven motor 320 which drives and operates the pump 310. The vacuum source 300 may further comprise a silencer 330 attached to the pump 310 and an exhaust muffler 340 attached to the motor 320 so that the vacuum source 300 may be operated with less noise (i.e. for quieter operations in or near residential areas).

The water is then passed through the filtration tank 400 so that the water is filtered and cleaned for re-use by the power wash system 10. As shown in FIGS. 4 and 5, one way of passing the water through the filtration tank 400 is by attaching the inlet 350 of the vacuum source 300 to the clean end of tank 400 (i.e. the right side of tank 400 in FIG. 5) using an attaching means 360. The vacuum source creates a low pressure in tank 400, transport hose 61 and reclamation ring 62 which sucks the water through holes 63 of ring 62, through hose 61, and then through the entire tank 400.

Figure 5A:
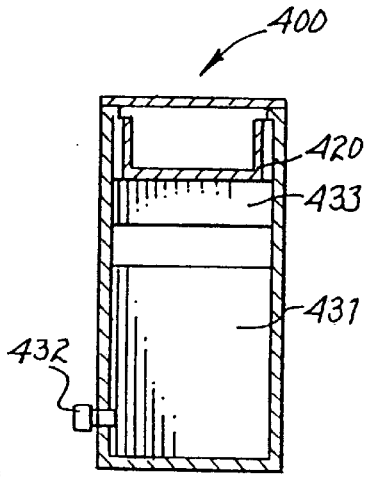
FIG. 5A is a side sectional elevation view of the water filtration tank for the water reclamation and filter recycling system taken along the line SA—SA of FIG. 5.

As shown in FIGS. 5 and 5A, the filtration tank 400 comprises an inlet 410 located at the top, a removable slanting trough 420 located in the upper portion of the tank, a screened trough outlet 425 located at the bottom of trough 420, a plurality of cascading chambers 430 located in the lower portion of the tank, a drain 432 for each chamber 430, and baffles 433 also located in the central portion of the tank between the trough outlet 425 and the vacuum source inlet 360.

The reclaimed water is passed to the tank 400 through inlet 410, and the water flows downwardly along the trough 420 to the screened outlet 425. Large debris and particles are removed from the water when the water passes through screened outlet 425, and the debris and particles are left in the trough 420 in the upper portion of the tank 400. The trough 420 is removable from tank 400 so that the large debris and particles can be easily cleaned from it.

The water is then successively passed to a plurality of cascading chambers 430. The chambers 430 are each separated by a series of dividing walls 431 that are descending in height. The water successively fills each chamber and then flows over to the next adjacent chamber so that debris and particles still present in the water are left in the chambers 430, and cleaner water is continuously passed to the next chamber. The water is then sufficiently cleaned for re-use when it reaches the last chamber 436.

The filtered water exits the tank 400 through outlet 435 located in the last chamber 436 after passing through a one-way, spring loaded, water check valve (not shown) and is transported by gravity feed or by pump (not shown) through a transport means 440 to storage means 20 so that the filtered water is returned to be further used for cleaning by the power wash system 10. If a pump is used, the pump may be automatically operated by a float switch (not shown) which regulates the water level between predetermined high (pump ON) and low (pump OFF) water levels. A drain 432 is provided for each chamber 430 so that the debris and particles that remain in these chambers can be removed.

A plurality of baffles 433 are located below the trough 420 and generally above the chambers 430 to prevent debris, particles, and water from being directly vacuumed into inlet 360 of vacuum source 300. These baffles 433 ensure that the vacuum source 300 and the reclamation and recycling system 60 operate properly.

Detailed Description of the Improved Rotary Union

As stated earlier, a rotary union is typically mounted in the central portion atop the base 52 of the sprayer 50, and it acts as a seal and coupling for passing high pressure and high temperature water to the spray bar 54. The rotary union is used to maintain the water pressure sufficiently high so that the spray bar 54 rotatingly sprays the water downwardly at high speeds.

The problem with prior art rotary unions (i.e. rotary union 200 of FIG. 6) was that the parts of the rotary unions generally wore out at a fairly fast rate because the device was operated under high pressure and high temperature. The wearing out of these parts would cause the seal of these rotary unions to leak, and the result would be that the water cyclone sprayer 50 would not function properly or effectively.

FIGS. 7, 7A, 7B and 8 show subassemblies of components for an improved rotary union 100 according to the present invention. This rotary union 100 is a more effective coupling for passing high temperature and high pressure water to a spray bar without causing any leaks in the sprayer 50 and for sufficiently maintaining the water pressure high enough to provide very high speed rotation of the spray bar 54. This improved rotary union 100 is also designed to be more durable since its components do not wear out as fast as the components of the prior art rotary unions. At high temperatures small amounts of water can "weep" through the engaging surfaces of the silicon carbide components.

The improved rotary union 100 includes a first subassembly of components 110 fixedly and non-rotatably mounted to the frame attached to the base 52 of the sprayer 50 and a second subassembly of components 150 rotatably mounted within the first subassembly 110. The first subassembly 110 provides a first silicon carbide seal surface 125 which is fixed, and the second subassembly 150 provides a second silicon carbide seal surface 165 which rotates at high speed and presses against the first silicon carbide seal surface 125 to create the more effective seal for water passing through the central bore of rotary union 100.

As shown in FIG. 7, the first subassembly of components 110 comprises a fixed housing 130, which is mounted to the base 52 of the sprayer 50, and a first floating silicon carbide seal member 120, which is non-rotatably, slidably mounted in cylindrical recess 115 in the housing 130 below the inlet 140 and above the recess 145. The housing 130 has an inlet 140 located at its upper portion for receiving the water that is to be sprayed by sprayer 50 and has a recess 145 located at its lower portion for receiving the second subassembly of components 150.

Figure 7B:
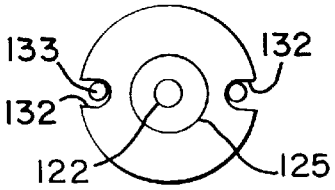
FIG. 7B is a bottom elevational view taken along the line 7B—7B of FIG. 7 showing the non-rational engagement of the upper floating seal support member.
Figure 7C:
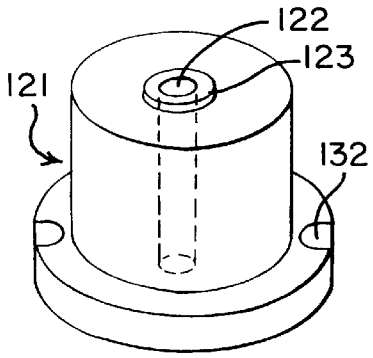
FIG. 7C—perspective view of the upside down T-shaped cylindrical support member.

FIG. 7A shows an enlarged side view of the first floating silicon carbide seal member 120. The seal member 120 comprises an upside down T-shaped cylindrical support member 121, a silicon carbide component 124 affixed at the discharge end of member 121, an o-ring 128, an inlet end member which may be a flat washer 126, and a steel spring 127. Spring 127 biases washer 126, o-ring 128 and support member 121 downwardly so that surface 125 presses against surface 165 when installed as a unit. The T-shaped cylindrical member 121, o-ring 128 and washer 126 have a central inside bore 122. As best seen in FIGS. 7B and 7C, member 121 has at its lower end a pair of recesses 132 which engage a pair of lugs 133 in the housing 130 to permit slidable (floating) but non-rotational movement of member 121 in recess 115. (Alternatively, member 121 may be formed with a pair of lugs which fit into recesses in housing 130). T-shaped member 121 at its other end also has a raised lip 123 at its upper portion extending into the central bore 121 of o-ring 128 and supporting its inner surface. The silicon carbide component 124 is affixed to the bottom of the T-shaped cylindrical member 121 and provides the first silicon carbide seal surface 125, which faces downwardly. The o-ring 128 is placed on top of the raised lip 123 of the cylindrical member 121, and the inner bore of the o-ring 128 abuts the raised lip 123.

The flat washer 126 is placed on top of the o-ring 128. The flat washer 126 comprises a counter-sunk inner bore 129, which extends partially into the inner bore of the o-ring 128 and abuts and supports its inner surface. The o-ring 128, in effect, is sandwiched between the end of raised lip 123 of the cylindrical member 121, on its one hand, and the end of countersunk bore 129 of the flat washer 126, on the other hand. The vertical edges 131 of washer 126 slidingly engage in the inner walls of recess 115 as shown in FIG. 7. This sandwiching feature prevents the o-ring 128 from being blown into the inner bore 122 of the cylindrical member 121 by the high pressure, high temperature water which is present at the interface between o-ring edges 131 and the outside diameter of member 121, on the one hand, and the walls of recess 115, on the other hand. This feature overcomes the problem with prior art rotary unions which have o-rings that are more easily blown into the inner bore by the high pressure or high temperature water. This sandwiching feature provides a novel way of retaining the o-ring 128 at its set location for proper operation of the rotary union. In this manner, o-ring 128 effectively seals the aforesaid interface and prevents high pressure water from by-passing the rotary union seal at surfaces 125, 165 by attempting to go around member 121 through the interface (slide fit) with recess 115 and cylindrical member 121.

FIG. 8 shows the second subassembly of components 150. The second subassembly 150 comprises a rotating spindle 170, a silicon carbide component 160, a roller bearing unit 180, a shaft collar 185, a spring clip retaining washer 190, and a sealing ring 195. The rotating spindle 170 has a central bore 161 to allow the water to flow through the rotary union 100. The silicon carbide component 160 is mounted at the top of the rotating spindle 170 to provide the second silicon carbide seal surface 165. In operation the second silicon carbide seal surface 165 is pressed and rotated against the first silicon carbide seal surface 125, to form an effective seal which prevents high pressure water passing through the rotary union 100 from leaking through the seal.

The sealing surfaces have been described in the preferred embodiment as being silicon carbide. The sealing surfaces may also be made of tungsten carbide or any other hard, durable material used as a sealing surface which is soft enough to effectively make a seal at the sealing surfaces yet is hard enough to give a long life to the sealing surfaces such as is provided by silicon carbide under the conditions in which the present invention is operated. Using silicon carbide sealing surfaces the lifetime of the sealing surfaces is in excess of 16,000 hours operating at 3000 psi, 250° F. and 1500 rpm.

The roller bearing unit 180 is attached to the central portion of the rotating spindle 170, and this unit 180 provides rotating support to the rotating spindle 170. The shaft collar 185 is also attached to the upper portion of the rotating spindle 170 for holding and supporting the roller bearing unit 180 to the rotating spindle 170. The roller bearing unit 180 comprises a pair of roller bearing columns 182, bearing supports 181 attached to the shaft collar 185, and a bearing spacer 183 attached between the two bearing rings 182. one roller bearing ring is mounted on top of the other at the central portion of the spindle 170. The roller bearing rings 182 provide the rolling function for rotating the spindle 170, and the bearing supports 181 hold the roller bearing rings 182 in position on the rotating spindle 170. The bearing spacer 183 separates the two columns 182 so that these columns can rotate independently.

The spring clip retaining washer 190 is attached below the roller bearing unit 180, and this washer 190 retains the second subassembly of components 150 within the first subassembly of components 110. The washer 190 is retained within a recess 146 at the lower portion of the first subassembly 110 to hold the second subassembly 150 in the first subassembly 110.

The rotating spindle 170 has a threaded portion 198 at its lower end for attaching and engaging a rotating spray bar 54. At each peripheral end of spray bar 54 is a nozzle 55 affixed with the open end of each nozzle pointing in opposite directions in a plane substantially perpendicular to the spray bar and at a downward vertical angle of about 6° to 20°. The upward reaction force to the downward force component of high pressure water exiting through nozzles 55 of spray bar 54 causes the second subassembly of components 150 to move upwardly towards the first subassembly of components 110 pressing face 165 upwardly against the downward bias of spring 127 and into sealing contact with-face 125. The horizontal reaction forces to the horizontal force component of high pressure water exiting through nozzles 55 of spray bar 54 causes the spray bar to rotate at very high rpm, i.e. 1500 rpm operating speed and 2000 rpm rated maximum speed. During operation the second silicon carbide surface 165 rotates against the first silicon carbide surface 125, and a sealing relationship is established between the two surfaces for water passing through the rotary union 100 at high pressure and temperature without leaking through or around the rotary union seal. Operational pressure of 3000 psi at 250° F. and 1500 rpm are readily achievable with the present invention.

A working model of the invention can be made using the following specifications:

Trailer: 10' long, weighs 1200 lbs. with ⅛" steel deck, 7000 lb. capacity, by Fleming Trailers, Glendale, Ariz.;

Storage Tank: 300 gallon capacity, fiberglass or poly material by Desert Sun Fiberglass, Phoenix, Ariz.;

Water Pump: Triplex piston, 3000 psi, 8 gallon/min pumping capacity, fan belt drive, by Giant Indus.;

Electric Generator: 2200 watts, 110 volts at 2700 rpm, fan belt drive by T&J Mfg. Co., Oshkosh, Wis.;

Gas Engine For Water Pump And Electric Generator: 2025 hp., 2 cylinder gas engine, 2700 rpm constant speed, double pulley output by Kohler, Kohler, Wis.;

Oil Burner: 450,000–1,000,000 BTU depending on fuel nozzle size. A 3.50 nozzle yields 520,000 BTU's by Beckett Indus., Elirya, Ohio;

Heating Coil: ½" steel pipe, schedule 80, 150' of coil by Farley's, Siloam Springs, Ark.;

Cyclone Sprayer: 4500 psi max, 10 gallon/min. at 250° F., 2000 rpm max, 1500 rpm operating speed, with either 18", 30" or 48" spray bar; any size nozzle from No. 2 (0.034 ID nozzle) to No. 10 (0.080 ID nozzle); nozzles oriented at 6° to 20° downward vertical angle perpendicular to spray bar longitudinal axis; No. 305 stainless steel spray bar; 4 10" rustproof standard rubber tires; T-6 aircraft grade aluminum cover and deck; mild steel handle; 7200 psi lever type shut off valve; 360° rubber rock guard around bottom of cyclone;

Reclamation Ring: 0.120" thick walls, 1" diameter mild steel tubing, about 170 ⅛" D holes in a 30" diameter reclamation ring;

Vacuum Pump: 14" Hg., 280 $ft.^3$ air flow per minute, through 2" spined poly hoses. Pump by Suttorbuilt Div. of Garnders-Denver, Chicago, Ill.

Gas Engine Drive For Vacuum Pump: 20–25 HP, 12 volt battery started, Kohler 2 cylinder gas engine, 2700 rpm constant speed, direct drive by Kohler, Kohler, Wis.;

Vacuum Pump Silencer: 3" model D-33, Stoddard Silencers, Grayslake, Ill.;

Reclamation Tank: 170 gal. capacity; ½" abs plastic, by Proto Plastics, Glendale, Aria.; 12" battery powered float operated on/off-switch which is "on" when water reaches about 7" and "off" when water reaches about 3" from the bottom of tank; ½" one-way, spring loaded, water check valve opened by the weight of water present in the inlet of the valve;

Gas Engine Muffler: standard Chevrolet muffler;

Water Pump For Line From Filter Tank To Storage Tank: 12 volt battery powered from the gas engine battery, 6 gallon/min capacity.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited, to the particular use contemplated. It is intended that the scope of the invention be defined by the claims appended hereto.

What is claimed:

1. In a method of cleaning matter from flat surfaces using a maneuverable cyclonic power wash unit of the type that sprays water at high rotating speeds in excess of 1,500 rpm and high pressures in excess of 3,000 psi, in combination with a water storage component, a water pump component and a filtering tank, and in which the method includes the steps of storing a supply of water in the water storage component to be used for cleaning, pumping and pressurizing water as it flows from the storage component, and directing the pressurized water to said cyclonic power wash unit that sprays the pressurized water onto the surfaces to be cleaned, wherein the improvement comprises the steps of:

providing a cyclonic power wash unit;

providing a mobile platform, that is separate from said cyclonic power wash unit, for bearing said water storage component, said water pump component and said filtering tank;

connecting the cyclonic power wash unit to said mobile platform by first and second flexible conduits;

mounting the water storage component on said mobile platform;

mounting the water pump component on said mobile platform;

mounting the filtering tank on said mobile platform;

mounting a vacuum component on said mobile platform;

providing a vacuum inlet in said filtering tank;

connecting said vacuum component to said vacuum inlet;

pressurizing water from said water storage component;

connecting said water pump component to said cyclonic power wash unit through said first conduit;

directing the pressurized water to said cyclonic power wash unit;

spraying the pressurized water onto a flat surface to be cleaned using said cyclonic power wash unit;

reclaiming a substantial portion of the water that has been sprayed onto the surfaces by said cyclonic power wash unit along with the matter that was acquired from the surface and directing the reclaimed water through said second conduit to said filtering tank wherein the step of reclaiming the water comprises the step of utilizing said vacuum component to vacuum the water through a plurality of openings in a hollow reclamation ring attached to said cyclonic power wash unit into said filtering tank;

filtering the reclaimed water containing said matter acquired from the surface to separate the matter from the water, wherein the step of filtering the reclaimed water comprises drawing the reclaimed water through said filtering tank; and recycling the filtered water from the filtering tank back into the water storage component so that the water may be further used for cleaning by the cyclonic power wash unit.

2. The method of cleaning flat surfaces using a maneuverable cyclonic power wash unit as set forth in claim 1 wherein the step of filtering the reclaimed water through the filtering tank further includes the steps of:

providing said filtering tank with a plurality of cascading chambers including a first and a last chamber;

providing said filtering tank with a screen having a screened outlet that is located over said first chamber;

flowing the reclaimed water including said matter acquired from the flat surface down through said screened outlet so that matter is retained by the screen and removed from the water;

flowing the water that passed through said screened outlet through said plurality of cascading chambers by successively filling the first chamber with water flowing downwardly into the first chamber such that the reclaimed water continues to flow downwardly toward the bottom of the first chamber and then back up toward the top of the first chamber allowing matter carried by water flowing into the first chamber to settle out at the bottom of the first chamber and water that returns to the top of the first chamber to flow over and downwardly into an adjacent chamber such that cleaner water is continuously passed to the next of said cascading chambers until said filtered water is sufficiently cleaned for recycling and is collected in said last of said cascading chambers; and preventing matter contained in the reclaimed water from being drawn into the vacuum inlet of said vacuum component.

3. In a method of cleaning matter from flat surfaces using a maneuverable cyclonic power wash unit, of the type that includes a water cyclonic sprayer that sprays water at high rotating speeds in excess of 1,500 rpm and high pressures in excess of 3,000 psi, in combination with a water storage component, a water pump component and a filtering tank, and in which the method includes the steps of storing a supply of water in the storage component to be used for cleaning, pumping and pressurizing the water as it flows from the storage component, and directing the pressurized water to a rotary union attached to the water cyclonic sprayer wherein the improvement comprises the steps of:

providing a water cyclonic sprayer;

providing a mobile platform, that is separate from said water cyclonic sprayer, for bearing said water storage component, said water pump component and said filtering tank;

providing a rotary union, attached to the water cyclonic sprayer, said rotary union having a non-rotary subassembly including a non-rotating sealing surface and a rotary subassembly having a rotating sealing surface that engages said non-rotating sealing surface, the sealing surfaces of each of said rotary and non-rotary subassemblies being formed from a hard durable material selected from the group consisting of silicon carbide, tungsten carbide and any other hard durable material which is soft enough to effect a seal at the sealing surfaces of said rotary and non-rotary subassemblies, yet hard enough to provide undiminished flow of high pressure water from said non-rotating subassembly to said rotary subassembly for sustained periods when operating at pressures in excess of 3,000 psi and speeds in excess of 1,500 rpm;

connecting the water cyclonic sprayer to said mobile platform by first and second flexible conduits;

mounting the water storage component on said mobile platform;

mounting the water pump component on said mobile platform;

mounting the filtering tank on said mobile platform;

pressurizing water from said water storage component in excess of 3,000 psi;

connecting said water pump component to the non-rotary subassembly of the rotary union through said first conduit;

directing said pressurized water from the non-rotary subassembly to said rotary subassembly;

causing said water cyclonic sprayer to rotate at a speed in excess of 1,500 rpm;

spraying said pressurized water onto a flat surface to be cleaned by said water cyclonic sprayer;

reclaiming a substantial portion of the water that has been sprayed onto the surface by said water cyclonic sprayer along with the matter that was acquired from the surface and directing the reclaimed water through said second conduit to said filtering tank;

filtering the reclaimed water containing said matter acquired from the surface to separate the matter from the water; and recycling the filtered water from the filtering tank back into the water storage component so that the water may be further used for cleaning by the cyclonic power wash unit.

4. In a method of cleaning matter from flat surfaces using a maneuverable cyclonic power wash unit as set forth in claim 3 wherein said components further include a water heater component and the method further comprising the step of:

mounting a water heater component on said mobile platform;

heating the pressurized water in said water heater component before the water is sprayed through the water cyclonic sprayer onto the surface to be cleaned.

5. The method of cleaning flat surfaces using a cyclonic power wash unit as set forth in claim 3 further comprising the steps of:

transporting the components and said filtering tank to and from a job site on said mobile platform.

6. The method of cleaning flat surfaces using a maneuverable cyclonic power wash unit as set forth in claim 3 wherein said components further include a vacuum component and the method further providing the steps of:

mounting a vacuum component on said mobile platform;

providing a vacuum inlet in said filtering tank;

connecting said vacuum component to said vacuum inlet; and reclaiming a substantial portion of the water that has been sprayed onto the surface by vacuuming the water with said vacuum component.

7. The method of cleaning flat surfaces using a maneuverable cyclonic power wash unit as set forth in claim 3 wherein the step of filtering the reclaimed water includes the steps of:

providing said filtering tank with a plurality of cascading chambers including a first and a last chamber;

providing said filtering tank with a screen having a screened outlet that is located over said first chamber;

flowing the reclaimed water including said matter acquired from the flat surface down through said screened outlet so that matter is retained by the screen and removed from the water;

flowing the water that passed through said screened outlet through said plurality of cascading chambers by successively filling the first chamber with water flowing downwardly into the first chamber such that the reclaimed water continues to flow downwardly toward the bottom of the first chamber and then back up toward the top of the first chamber allowing matter carried by water flowing into the first chamber to settle out at the bottom of the first chamber and water that returns to the top of the first chamber to flow over and downwardly into an adjacent chamber such that cleaner water is continuously passed to the next of said cascading chambers until said filtered water is sufficiently cleaned for recycling and is collected in the last of said cascading chambers; and preventing matter contained in the reclaimed water from being drawn into the vacuum inlet of said vacuum component.

* * * * *